US009277311B2

(12) United States Patent
Schwerdtfeger et al.

(10) Patent No.: US 9,277,311 B2
(45) Date of Patent: Mar. 1, 2016

(54) CONTROLLING A SPEAKER ARRANGEMENT IN A VEHICLE

(71) Applicant: VOLKSWAGEN AG, Wolfsburg (DE)

(72) Inventors: Timm Schwerdtfeger, Braunschweig (DE); Jörg Helmold, Liebenburg (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 14/488,486

(22) Filed: Sep. 17, 2014

(65) Prior Publication Data

US 2015/0078580 A1 Mar. 19, 2015

(30) Foreign Application Priority Data

Sep. 17, 2013 (DE) ..... 10 2013 218 558

(51) Int. Cl.
*H04R 1/32* (2006.01)
*H04S 7/00* (2006.01)

(52) U.S. Cl.
CPC ..... *H04R 1/323* (2013.01); *H04S 7/302* (2013.01); *H04R 2499/13* (2013.01)

(58) Field of Classification Search
CPC ..... H04R 1/323; H04R 2499/13; H04S 7/302
See application file for complete search history.

(56) References Cited

U.S. PATENT DOCUMENTS

| | | | | |
|---|---|---|---|---|
| 5,321,760 | A | 6/1994 | Gray | |
| 7,702,123 | B2 * | 4/2010 | Soerensen | H04R 1/026 181/176 |
| 7,787,637 | B2 * | 8/2010 | Kong | H04R 1/345 381/302 |

FOREIGN PATENT DOCUMENTS

| | | | |
|---|---|---|---|
| DE | 19654416 | C1 | 5/1998 |
| DE | 19851490 | A1 | 5/2000 |
| DE | 10324640 | B3 | 5/2004 |
| DE | 10361041 | A1 | 6/2005 |
| DE | 102004045827 | A1 | 3/2006 |
| DE | 102009058492 | A1 | 6/2011 |
| DE | 102011079838 | A1 | 5/2012 |
| DE | 102011107312 | A1 | 3/2013 |
| EP | 2181895 | A2 | 5/2010 |
| WO | 2005081520 | A1 | 9/2005 |

OTHER PUBLICATIONS

Search Report for German Patent Application No. 10 2013 218 558.8; Jul. 15, 2014.

* cited by examiner

*Primary Examiner* — Ping Lee
(74) *Attorney, Agent, or Firm* — Barnes & Thornburg LLP

(57) ABSTRACT

A method for controlling a loudspeaker arrangement in a vehicle. The loudspeaker arrangement can be adjusted to at least an inoperative position, a projecting position, and an operating position. An operating state of the vehicle is detected and the loudspeaker arrangement is automatically adjusted between the inoperative position and the projecting position depending on the operating state of the vehicle. An operating state of an audio apparatus of the vehicle is detected and the loudspeaker arrangement is automatically adjusted between the projecting position and the operating position depending on the operating state of the audio apparatus.

13 Claims, 3 Drawing Sheets

CONTROLLING A SPEAKER ARRANGEMENT IN A VEHICLE

PRIORITY CLAIM

This patent application claims priority to German Patent Application No. 10 2013 218 558.8, filed 17 Sep. 2013, the disclosure of which is incorporated herein by reference in its entirety.

SUMMARY

Disclosed embodiments relate to a method for controlling a loudspeaker arrangement in a vehicle, and also to a corresponding loudspeaker arrangement for a vehicle.

BRIEF DESCRIPTION OF THE DRAWINGS

The present disclosure will be described in detail below with reference to the attached drawing.

DETAILED DESCRIPTION OF THE DISCLOSED EMBODIMENTS

Figure 1:
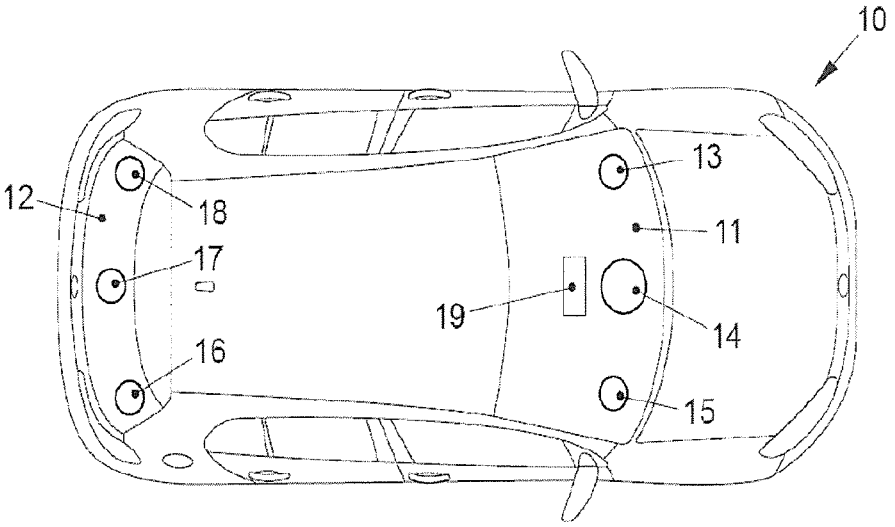
FIG. 1 shows a vehicle according to a first disclosed embodiment.

Disclosed embodiments provide an adjustable loudspeaker arrangement which is improved in comparison to the prior art.

Disclosed embodiments provide a method for controlling a loudspeaker arrangement in a vehicle, by a loudspeaker arrangement for a vehicle, and by a vehicle.

Disclosed embodiments provide a method for controlling a loudspeaker arrangement in a vehicle. The loudspeaker arrangement can be adjusted to an inoperative position, a projecting position and an operating position. As part of the method, an operating state of the vehicle is detected and the loudspeaker arrangement is automatically adjusted between the inoperative position and the projecting position depending on the operating state. Furthermore, an operating state of an audio apparatus of the vehicle is detected, the audio apparatus being coupled to the loudspeaker arrangement to output audio signals via the loudspeaker arrangement. Furthermore, the loudspeaker arrangement is automatically adjusted between the projecting position and the operating position depending on the operating state of the audio apparatus. In the imperative position, the loudspeaker arrangement can be accommodated, for example, in a recessed manner in a dashboard of the vehicle such that it is inconspicuous and protected against soiling. The presence of the loudspeaker arrangement can be visually emphasized, even if the associated audio apparatus is not yet active, by the operating state of the vehicle being detected and the loudspeaker arrangement being moved from the inoperative position to the projecting position when a specific operating state of the vehicle arises. The value of the loudspeaker arrangement and the associated audio apparatus can be emphasized as a result. The loudspeaker arrangement can be moved to a suitable position for emitting sound during operation of the audio apparatus by further adjusting the loudspeaker arrangement from the projecting position to the operating position, depending on the operating state of the audio apparatus. Furthermore, the loudspeaker arrangement can be adjusted to specific operating positions depending on specific settings on the audio apparatus, the operating settings being matched to the sound conditions in the vehicle and the desired sound properties of the audio apparatus. The entire audio system can be set up in a suitable manner by adjusting the loudspeaker arrangement in several stages and in steps, depending on the various operating states.

According to at least one disclosed embodiment, the loudspeaker arrangement can be adjusted with respect to a loudspeaker arrangement receptacle. The loudspeaker arrangement is at least partially recessed in the loudspeaker arrangement receptacle in the inoperative position, and the loudspeaker arrangement protrudes further out of the loudspeaker arrangement receptacle in the projecting position than in the inoperative position. As described above, the presence of an expensive audio apparatus and associated expensive loudspeaker arrangements can be visually displayed even before operation of the audio apparatus by the loudspeaker arrangement being extended out of the loudspeaker arrangement receptacle.

Furthermore, it is possible to provide a logo or lettering, for example a trade name, on an outer edge of the loudspeaker arrangement for example, the logo or lettering becoming visible by virtue of the loudspeaker arrangement being extended to the projecting position. Owing to this visual effect, attention can be drawn to the audio system, for example when entering the vehicle, and as a result the presence and value of the audio system of the vehicle can be emphasized.

In a further disclosed embodiment, the loudspeaker arrangement is automatically rotated and additionally or alternatively automatically shifted with respect to the loudspeaker arrangement receptacle when the loudspeaker arrangement is adjusted between the inoperative position and the projecting position. Owing to these effects, the attention paid by a vehicle user to the loudspeaker arrangement can be further increased.

In a further disclosed embodiment, the loudspeaker arrangement is adjusted between the projecting position and the operating position by automatic tilting. As an alternative or in addition, the loudspeaker arrangement can be adjusted between the projecting position and the operating position by automatically rotating the loudspeaker arrangement with respect to the loudspeaker arrangement receptacle. By virtue of rotating and/or tilting the loudspeaker arrangement, a sound-outlet region of the loudspeaker arrangement can be adjusted and therefore sound emission can be optimized for one or more occupants of the vehicle or can be adapted to the sound conditions in the interior of the vehicle. By way of example, the size of a person in the vehicle can be detected and the loudspeaker arrangement can be automatically tilted depending on the size of the person. The size of the person in the vehicle can be detected, for example, using a camera in the vehicle or a configuration of the audio apparatus.

According to at least one disclosed embodiment, the loudspeaker arrangement comprises adjustable fins. The fins are arranged, for example, in the region of a sound-outlet opening in the loudspeaker arrangement. Therefore, audio signals, which are emitted by the loudspeaker arrangement, are emitted through the adjustable fins. In the method, the fins are automatically adjusted depending on the operating state of the audio apparatus. By way of example, the fins can influence an audio emission angle in the vertical direction, that is to say a vertical angle of the audio emission direction. As a result, the audio signal emission by the loudspeaker arrangement can be adapted to the sound conditions in the vehicle or to an occupant.

Furthermore, as a part of the method, a size of a person in the vehicle can be detected and the fins can be automatically adjusted depending on the size of the person. Therefore, the audio signal can be output in an optimized manner for a driver of a specific size by adjusting the vertical angle of the audio emission. As an alternative or in addition, the fins can also be designed to influence the audio emission direction in the horizontal direction, so that any desired sound emission in the horizontal and/or vertical direction can be influenced by automatically adjusting the fins.

According to a further disclosed embodiment, detecting the operating state of the vehicle comprises detecting a locking state of a door of the vehicle. The locking state of the door of the vehicle can be changed, for example, by locking or unlocking a door lock of the door with the aid of a key or radio remote control or a transponder of a keyless access system. In the unlocked state, the loudspeaker arrangement can be automatically moved, for example, from the inoperative position to the projecting position. This creates a kind of welcoming effect when a user of the vehicle unlocks the vehicle. As an alternative or in addition, a door-opening state of the door can be detected as the operating state of the vehicle, to adjust the loudspeaker arrangement between the inoperative position and the projecting position. The door-opening state indicates whether a door of the vehicle is open or not. Finally, as an alternative or in addition, an ignition state of the vehicle can be detected, the ignition state indicating that starting is enabled for a drive motor of the vehicle by a keyless start system of the vehicle, or indicating whether an ignition key is inserted into an ignition lock of the vehicle. If it is determined by means of the ignition state that the ignition of the vehicle is switched on, the loudspeaker arrangement can be moved, for example, from the inoperative position to the projecting position, and in the case of the ignition being switched off, the loudspeaker arrangement can be moved in the opposite direction from the projecting position to the inoperative position.

Detecting the operating state of the audio apparatus can comprise detecting a switch-on state of the audio apparatus, which indicates whether the audio apparatus is switched on. When the audio apparatus is switched on, the loudspeaker apparatus can be adjusted, for example, from the protruding position to the operating position, and when the audio apparatus is switched off, the loudspeaker arrangement can be adjusted back to the projecting position again. As an alternative or in addition, a user setting on the audio apparatus can be detected as the operating state of the audio apparatus. The user setting can comprise, for example, a selection, with which user setting one or more seat positions in the vehicle are selected as hearing positions. The loudspeaker arrangement can be adjusted to a corresponding operating position depending on the user setting, to be able to provide an optimized audio output for the selected seat positions.

In a further disclosed embodiment, at least a portion of the loudspeaker arrangement is automatically illuminated depending on the operating state of the vehicle. By way of example, lettering or a logo can be provided on the loudspeaker arrangement, the lettering or logo being externally illuminated or having its own illumination means. The illumination means can be switched on, for example, at the same time as the loudspeaker arrangement is adjusted from the inoperative position to the projecting position, and can be switched off when the loudspeaker arrangement is adjusted back to the inoperative position. As a result, the attention paid by the user of the vehicle to the loudspeaker arrangement can be further increased.

According to the present disclosure, a loudspeaker arrangement for a vehicle is further provided, the loudspeaker arrangement comprising a drive and a processing apparatus. The drive is capable of adjusting the loudspeaker arrangement at least to an inoperative position, a projecting position and an operating position with respect to a loudspeaker arrangement receptacle. The processing apparatus is designed to drive the drive depending on an operating state of the vehicle and an operating state of an audio apparatus. The audio apparatus is coupled to the loudspeaker arrangement for the purpose of outputting audio signals. The processing apparatus is designed to adjust the loudspeaker arrangement between the inoperative position and the projecting position depending on the operating state of the vehicle, and to adjust the loudspeaker arrangement between the projecting position and the operating position depending on the operating state of the audio apparatus. Therefore, the loudspeaker arrangement is suitable for carrying out the above-described method and its embodiments and comprises the advantages described above in connection with the method.

Finally, the present disclosure provides a vehicle which comprises an audio apparatus and the above-described loudspeaker arrangement. The loudspeaker arrangement can comprise, for example, a central loudspeaker or a side loudspeaker in the front or rear region of the vehicle. A plurality of the above-described loudspeaker arrangements can also be arranged in the vehicle. The front central loudspeaker can be arranged, for example, centrally in a dashboard of the vehicle in relation to the lateral direction of the vehicle. The front side loudspeaker can be arranged to the outer left or to the outer right in the dashboard of the vehicle in relation to the lateral direction of the vehicle. The rear central loudspeaker can be arranged substantially centrally, for example, in a parcel shelf or loading-space cover of the vehicle in relation to the lateral direction of the vehicle. Finally, the rear side loudspeaker can be arranged to the outer left or to the outer right in the parcel shelf or the loading-space cover of the vehicle in relation to the lateral direction of the vehicle. Owing to the arrangement of the loudspeaker both in the center of the vehicle and also to the outer right and the outer left, corresponding audio signals can be suitably emitted to the vehicle interior depending on the setting and driving of the loudspeaker arrangements. Furthermore, it is possible to play back stereo signals or so-called surround signals.

FIG. 1 shows a vehicle 10 with a dashboard 11 and a parcel shelf or loading-space cover 12. Loudspeaker arrangements 13-18 are arranged both in the dashboard 11 and in the parcel shelf 12. The loudspeaker arrangements 13-18 are coupled to an audio apparatus 19 of the vehicle 10, for example to a car radio, to a CD player or to a multimedia playback apparatus. The number and positions of the loudspeaker arrangements 13-18 is only exemplary and can be changed as desired. The loudspeaker arrangement 13-18 will be described in detail below with reference to FIGS. 2-5. Each of the loudspeaker arrangements 13-18 comprises at least one loudspeaker for playing back audio signals. As shown in FIG. 1, the loudspeaker arrangements 13-18 can be arranged, for example, substantially centrally in relation to the lateral direction of the vehicle, like loudspeaker arrangements 14 and 17 for example. Loudspeaker arrangements of this kind are also called center speakers. Furthermore, the loudspeaker arrangements can be arranged to the outer left in relation to the lateral direction of the vehicle, like loudspeaker arrangements 13 and 18 for example, or to the outer right in relation to the lateral direction of the vehicle, like loudspeaker arrangements 15 and 16 for example, to allow, for example, stereo playback or so-called surround playback of audio signals in the vehicle interior. In addition to playing back multimedia signals, the audio apparatus 19 can also be designed to play back messages to the driver, for example, a navigation system.

Figure 2:
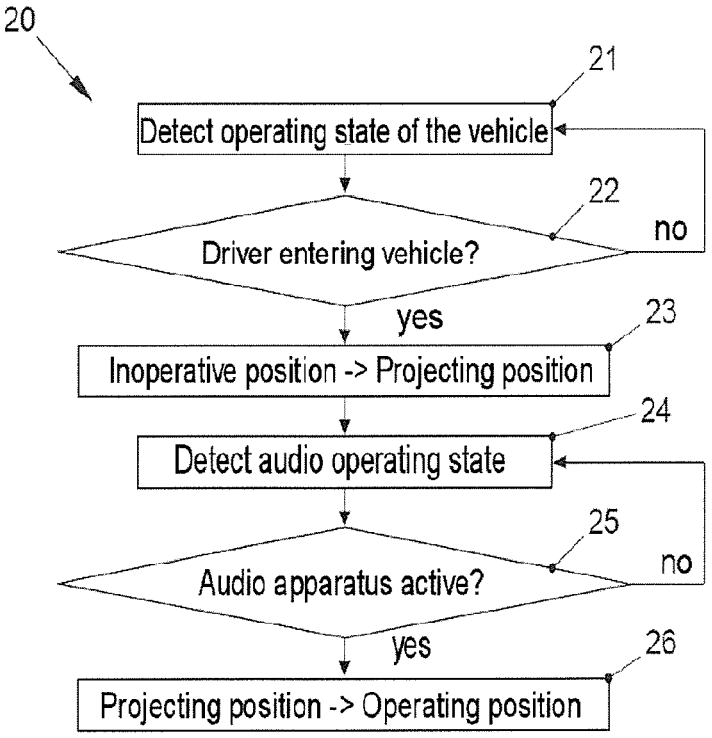
FIG. 2 shows method steps of a method according to at least one disclosed embodiment.
Figure 4:
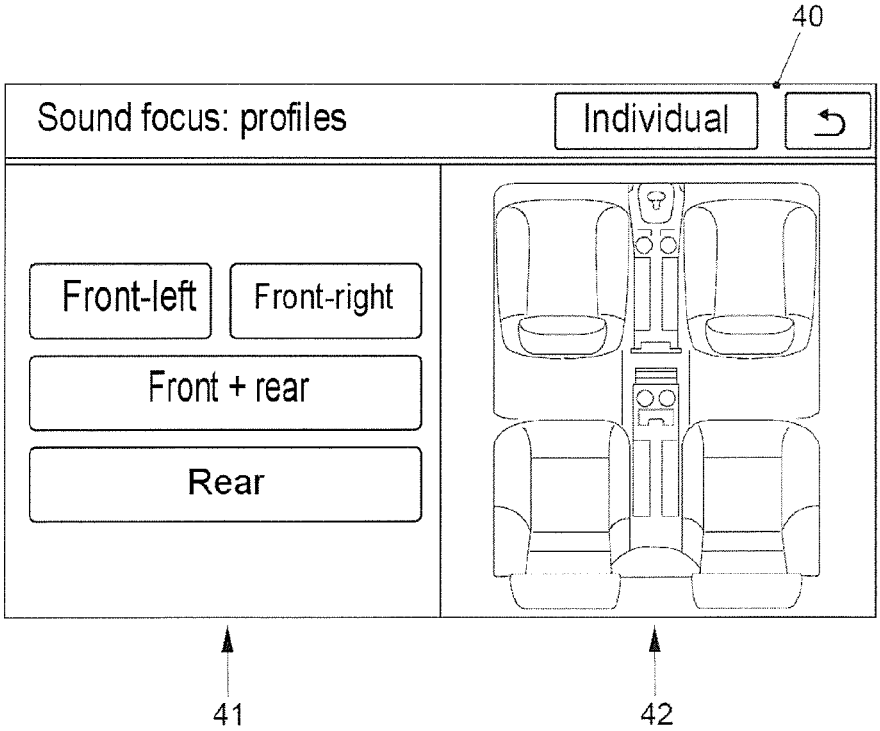
FIG. 4 shows a configuration menu of an audio apparatus of a vehicle.
Figure 5:
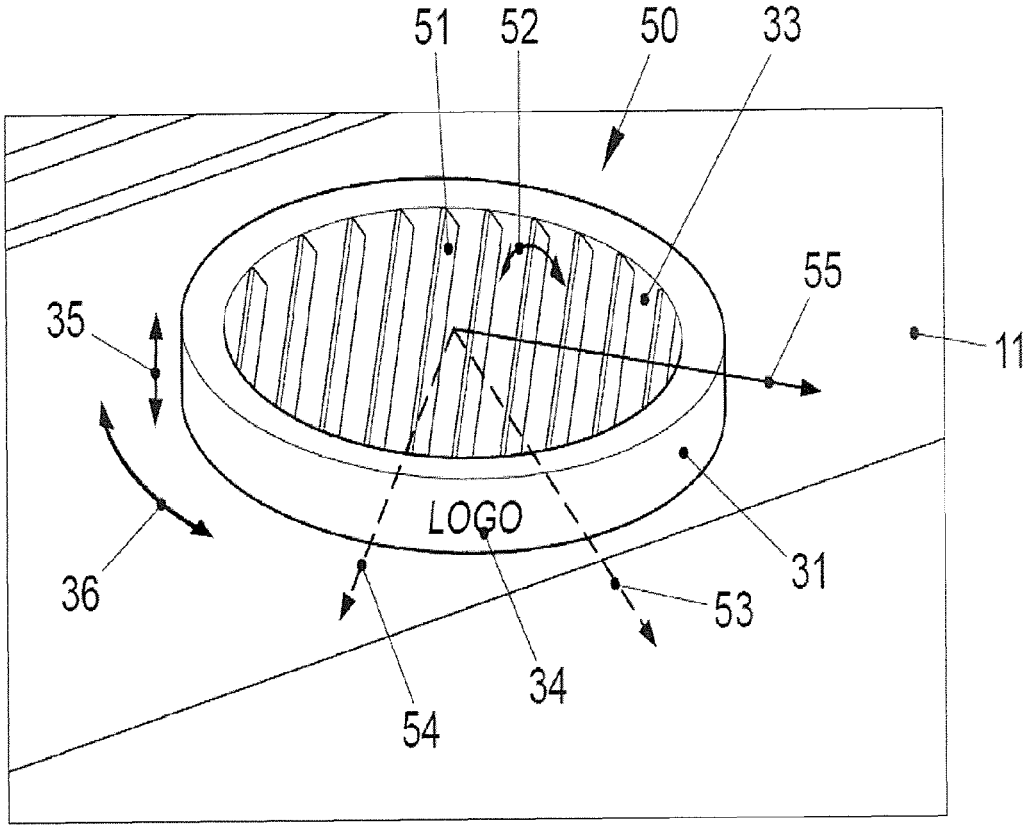
FIG. 5 shows a loudspeaker arrangement according to a further disclosed embodiment.

The loudspeaker arrangements 13-18 or at least some of these loudspeaker arrangements 13-18 can be arranged in the dashboard 11 and/or the parcel shelf 12 in an automatically adjustable manner, as will be described in detail below with reference to FIGS. 3 and 5. FIG. 2 shows method steps which describe how the loudspeaker arrangements 13-18 are automatically adjusted. In the method 20 shown in FIG. 2, an operating state of the vehicle is first detected in step 21. The operating state of the vehicle can comprise, for example, an opening state of a door of the vehicle 10 or an ignition state of the vehicle 10. Expressed in general, the operating state of the vehicle can indicate whether a user of the vehicle 10 is entering or exiting the vehicle. In step 22, the operating state of the vehicle is used to establish whether a driver is entering the vehicle. For as long as this is not the case, the method is continued in step 21. When a driver enters the vehicle, at least one of the loudspeaker arrangements 13-18 moves from a recessed inoperative position in the dashboard to a projecting position in step 23. By way of example, at least one of the loudspeaker arrangements can be extended a few millimeters out of the dashboard 11, the parcel shelf 12 or another switch panel of the vehicle 10 when a door is opened or at another defined time in relation to a change in an operating state of the vehicle. The loudspeaker arrangement can additionally rotate in the process. An audio operating state of the audio apparatus 19 is then detected in step 24. In step 25, a decision is made, depending on the audio operating state, as to whether one or more of the loudspeaker arrangement 13-18 will be adjusted from the projecting position to an operating position (step 26). By way of example, this can be performed depending on whether the audio apparatus is switched on or depending on specific configurations of the audio apparatus 19, as will be described below with reference to FIG. 4.

When the audio apparatus 19 is switched off or deactivated, the loudspeaker arrangements 13-18 can be adjusted back from the operating position to the projecting position, and, when the driver exits the vehicle, moved back from the projecting position to the inoperative position.

Figure 3:
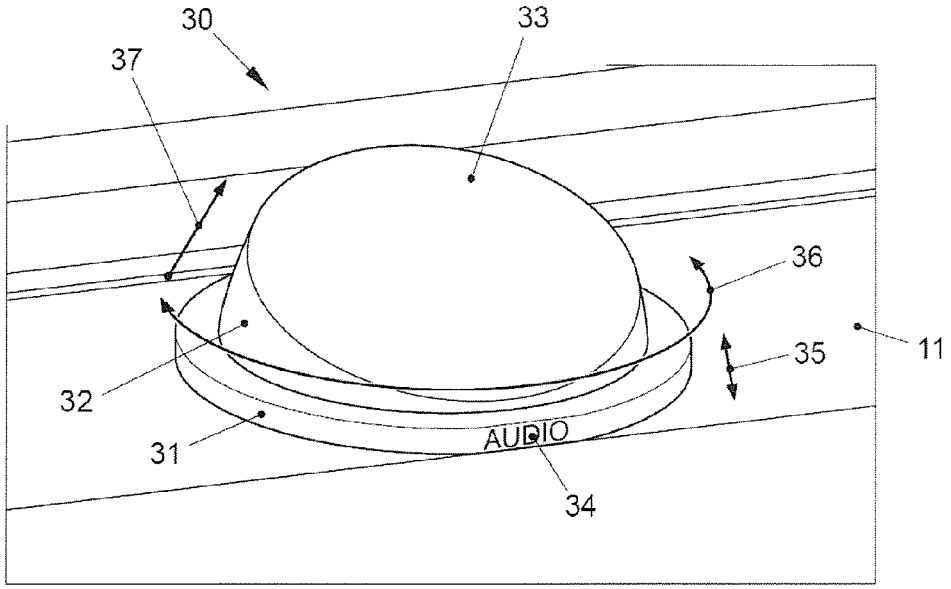
FIG. 3 shows a loudspeaker arrangement according to at least one disclosed embodiment.

FIG. 3 shows a first embodiment of the loudspeaker arrangements 13-18 of FIG. 1 in detail. The loudspeaker arrangement is denoted by reference symbol 30 in FIG. 3. The loudspeaker arrangement 30 is arranged in a loudspeaker arrangement receptacle which is formed by the dashboard 11 in the disclosed embodiment which is shown in FIG. 3. The loudspeaker arrangement 30 has a lower housing part 31 which is fitted in the dashboard 11 such that it can be adjusted in the direction of the arrow 35. A drive, for example an electric drive, can be provided to adjust the lower housing part 31 in the direction of the arrow 35 and can be driven by a corresponding processing apparatus (not shown). Driving by the processing apparatus can be performed, as described above, depending on the operating state of the vehicle and the audio operating state. The lower housing part 31 can furthermore be fitted in the dashboard 11 such that it can rotate in the direction of the arrow 36, wherein the rotating adjustment can likewise be realized with the aid of the above-described drive. An upper housing part 32 is fitted to the lower housing part 31, the upper housing part having a sound-outlet opening 33 on its upper surface, the sound-outlet opening being protected, for example, by a corresponding screen. A loudspeaker (not shown) which can output audio signals through the sound-outlet opening 33 is located within the loudspeaker arrangement 30. The upper housing part 32 can be automatically tilted in the direction of the arrow 37. A corresponding drive (not shown) can be provided for automatically adjusting the upper housing part 32 in the direction of the arrow 37. Lettering 34 or a logo can be provided on a side wall of the lower housing part 31, the lettering or logo indicating the manufacturer of the audio system for example.

The manner of operation of the loudspeaker arrangement 30, in particular the movements of the loudspeaker arrangement 30, will be described by way of example in the text which follows. When the vehicle doors are opened, the loudspeaker arrangement 30 comprising the lower housing part 31 and the actual loudspeaker housing 32 extends out of the dashboard 11 from the inoperative position to the projecting position by, for example, 5-10 mm in the direction of the arrow 35. A loudspeaker can be arranged in the upper housing part 32. The loudspeaker can be mounted, for example, at a constant distance of, for example, 5 mm below the sound-outlet opening 33 which is covered by a loudspeaker grid for example. The loudspeaker can leave its relative position to the loudspeaker grid or to the sound-outlet opening 33 unchanged during the entire sequence. Once the loudspeaker is extended, a brand-specific label 34, which is not visible in the recessed state, that is to say in the inoperative position of the loudspeaker arrangement 30, can be visible on the edge surface or end surface of the lower housing part 31 which is now visible. The logo or the lettering 34 can be illuminated or emphasized in some other way. When the audio apparatus 19, for example an infotainment system, which is coupled to the loudspeaker arrangement 30 is started, the upper housing part 32 can be tilted, for example, additionally through approximately 10° in the direction of the passenger compartment or vehicle interior, as is illustrated by the arrow 37. The loudspeaker arrangement is therefore moved from the projecting position to the operating position. The audio apparatus 19 can comprise a user interface which is illustrated in FIG. 4 by way of example. The audio playback for specific seats can be optimized by way of the user interface 40. The audio playback, for example, at the front-left seat, the front-right seat, all of the front and rear seats, or only at the rear seats can be optimized with the aid of the operator control elements 41. A corresponding selection for which seat or for which seats sound output is optimized will be displayed on the user interface 40 in the area 42 where the corresponding seats for which sound output is optimized are displayed in an emphasized manner. Depending on the setting of this so-called audio output focus, it is possible, by way of example, for only the angled upper housing part 32 to rotate or for the entire loudspeaker arrangement 30 comprising the upper housing part 32 and the lower housing part 31 to rotate. When the loudspeaker arrangement 30 is, for example, the central loudspeaker 14 which is shown in FIG. 1, the loudspeaker arrangement 30 can be rotated, for example, in the direction of the arrow 36 through 30° to the left to move the audio focus to the front-left or through 30° to the right to move the audio focus to the position front-right. If the audio output is intended to be optimized for all front and rear seats, or is intended to be optimized for the two rear seats, the loudspeaker arrangement 30 can be adjusted to a central position.

When the audio apparatus is switched off, the loudspeaker arrangement can be tilted back to the projecting position, and when the vehicle is turned off, the loudspeaker arrangement 30 can be recessed back into the dashboard 11 substantially to the inoperative position.

A further disclosed embodiment of a loudspeaker arrangement 50 will be described below with reference to FIG. 5, it being possible to use the loudspeaker arrangement 50, like the loudspeaker arrangement 30 of FIG. 3, as one of the loudspeaker arrangements 13-18 of FIG. 1. The loudspeaker arrangement 50 comprises a lower housing part 31, a so-called base plate, which is fitted in the dashboard 11 such that it can be moved by a drive (not shown), for example an electric drive. The lower housing part 31 can be moved in the direction of the arrow 35 from an inoperative position, in which the lower housing part 31 is arranged in a substantially recessed manner in the dashboard 11, to a projecting position, as is shown in FIG. 5. In addition, the lower housing part 31 can be rotated in the direction of the arrow 36. A sound-outlet opening 33, beneath which a loudspeaker (not shown) which can be connected, for example, to the lower housing part 31 and can be moved with the lower housing part 31, is located on an upper face of the lower housing part 31. Fins 51 which can be automatically adjusted by a suitable drive are arranged in the sound-outlet opening 33. The fins can be tilted in the direction of the arrow 52. Therefore, the sound-outlet opening 33 can be substantially closed or opened, wherein a sound-outlet direction is prespecified by tilting of the fins 51 in the open state. The sound-outlet direction can further be influenced by the lower housing part 31, together with the fins 51, being rotated, as a result of which a sound direction in the horizontal direction can be prespecified.

The manner of operation of the loudspeaker arrangement 50 will be described in detail in the text which follows. The loudspeaker arrangement 50 can be arranged in the dashboard 11, for example, as a central loudspeaker 14. In the switched off and locked state of the vehicle, the fins are oriented, for example, in the direction of travel and shut, so that the sound-outlet opening 33 is substantially closed. Furthermore, the lower housing part 31 is recessed in the dashboard 11 to such an extent that an upper edge of the lower housing part 31 terminates substantially flush with the dashboard 11. When the doors of the vehicle are opened or when the ignition of the vehicle is switched on, the loudspeaker arrangement extends, for example together with a rotation through 90° in the direction of the arrow 36, upward out of the dashboard 11 by 5 to 10 mm in the direction of the arrow 35. A logo or lettering 34, which can be emphasized by an illumination means, can be provided on a now-visible edge of the lower housing part 31. The fins 51 are now oriented substantially parallel to the dashboard, that is to say in the lateral direction of the vehicle. When the audio apparatus 19 is started, the fins 51 open through, for example, 45-90° in the direction of the arrow 52, so that the loudspeaker which is situated beneath them is now unblocked. A lens effect can be achieved by tilting the fins, as a result of which targeted sound emission is possible. The sound waves can propagate from the loudspeaker in different directions in the passenger compartment depending on the opening angle of the fins. Depending on the setting of a focus of sound emission, as was described above in connection with FIG. 4, the loudspeaker arrangement can be rotated from the sound-propagation direction (arrow 55), which is shown in FIG. 5, along the arrow 36, to emit the sound in a targeted manner, for example in the direction of the arrows 53 or 54. Sound can be emitted, for example, in the direction of a driver position, a passenger position or a central position. To this end, the loudspeaker arrangement 50 can be rotated, for example, in each case through 30° to the left or to the right from the central position.

The propagation of sound to occupants of different sizes can be adjusted by means of different setting angles of the fins 51. The size of the occupants can be detected, for example, automatically by means of cameras which are located in the vehicle or can be selected by a user by means of suitable configuration means, for example in several stages (low, middle and high). When the audio apparatus 19 is switched off and when the vehicle 10 is switched off, the loudspeaker arrangement 50 is adjusted in correspondingly opposite directions, so that the loudspeaker arrangement 50 is again arranged in the recessed inoperative position in the dashboard 11 when the vehicle is in the turned-off state.

In vehicles, such as passenger cars or heavy goods vehicles for example, loudspeakers are used for playing back audio signals. The audio signals can comprise, for example, audio outputs from an entertainment system of the vehicle or from a navigation system of the vehicle. A large number of loudspeakers are installed in different positions in a vehicle owing to the conditions in a vehicle which make it difficult to hear and owing to the limited installation space. In premium class vehicles in particular, at least some loudspeakers can be arranged in an adjustable manner, to be extended, for example, out of a dashboard and oriented toward the occupants only when required.

In this context, DE 103 24 640 B3 discloses an apparatus for mounting a loudspeaker of a motor vehicle with a loudspeaker housing, which accommodates the loudspeaker, and a housing receptacle, which accommodates the loudspeaker housing. The loudspeaker housing can be moved from an inoperative position, in which it is recessed in the housing receptacle, to at least one operating position, in which it protrudes out of the housing receptacle, by means of a drive unit. In addition, the loudspeaker can also be pivoted or rotated about at least one geometric axis relative to the housing receptacle at least in one operating position.

Furthermore, U.S. Pat. No. 5,321,760 relates to a retractable loudspeaker arrangement for a vehicle, which loudspeaker arrangement has a housing which contains at least a loudspeaker, a first operating apparatus for selectively moving the housing between a retracted position and an extended position, and a second operating apparatus for rotating the housing laterally, so that the loudspeaker can be directed in the direction of the left-hand side or right-hand side of the vehicle interior. The operating apparatus is ultimately controlled by the driver or another occupant of the vehicle.

DE 10 2011 107 312 A1 relates to a method for controlling at least one loudspeaker of a loudspeaker system for a vehicle, in which method at least some of the sound from a sound source is shadowed for a sound zone and/or the sound from the sound source is partially or completely reflected in the direction of a sound zone by using at least one screen and/or at least one reflector, or the loudspeaker system is controlled by means of a seat-occupation sensor.

DE 10 2011 079 838 A1 relates to a pop-up tweeter. The pop-up tweeter includes a housing and a drive unit which is inserted into the housing. The drive unit is designed such that it can move upward and downward together with a loudspeaker within the housing. The pop-up tweeter is installed in a vehicle and designed to have an opening and closing structure which advantageously improves user convenience and provides a loudspeaker with an exterior design of greater marketability.

EP 2 181 895 A2 relates to a loudspeaker arrangement in which the position of the sound transmitter unit is adjustable. The position is set to achieve a better sound quality as is received by a listener. According to at least one disclosed embodiment, a tweeter can be mounted on a platform, in the case of which a motor-driven bearing arrangement provides asymmetrical shifting. In the event of a sequence of movements, a center point of the sound transmitter unit is initially raised and somewhat tilted and the center point is then tilted more and moved laterally.

DE 198 51 490 A1 relates to a nozzle arrangement for the ventilation, of which the ventilation direction can be adjusted, of a vehicle interior, which nozzle arrangement has a plurality of air-outlet channels which are arranged next to one another and can be oriented in the direction of flow. Each of the ventilation-outlet channels is a pivotable nozzle pipe piece which is inserted in a nozzle front wall. All of the nozzle pipe pieces are oriented in the same direction by means of a coupling arrangement. The nozzle arrangements can also serve as loudspeaker covers. The direction of the emission of sound can be adjusted in a desired manner by corresponding orientation of the nozzle pipe pieces.

DE 196 54 416 C1 relates to a screen for the interior of a vehicle having a grid-like surface which is provided with apertures in at least one subregion. The screen can be installed in side regions of an instrument panel, in a center console, in vehicle-body pillar trim panels or in seat backrests. These locations are particularly suitable for accommodating sound-boxes and ventilation nozzles.

WO 2005/081520 A1 relates to a loudspeaker arrangement which can be moved from a covered position to an exposed position using suitable means. The arrangement comprises an acoustic lens and is suitable for use in a vehicle hi-fi system.

As described above, adjustable loudspeaker arrangements are advantageous for improving sound playback in a vehicle. In addition to the sound properties, the visual design of the adjustable loudspeaker arrangement is important to a vehicle user when deciding whether to buy a vehicle.

LIST OF REFERENCE SYMBOLS

10 Vehicle
11 Dashboard
12 Parcel shelf, loading-space cover
13-18 Loudspeaker arrangement
19 Audio apparatus
20 Method
21-26 Step
30 Loudspeaker arrangement
31 Lower housing part
32 Upper housing part
33 Sound-outlet opening
34 Lettering, logo
35-37 Arrow
40 Screen output
41 Operator control element
42 Focus of audio output
50 Loudspeaker arrangement
51 Fin
52-55 Arrow

The invention claimed is:

1. A method for controlling a loudspeaker arrangement in a vehicle, wherein the loudspeaker arrangement can be adjusted to at least an inoperative position, a projecting position and an operating position, the method comprising:

detecting an operating state of the vehicle;

automatically adjusting the loudspeaker arrangement between the inoperative position and the projecting position depending on the operating state of the vehicle;

detecting an operating state of an audio apparatus of the vehicle, which audio apparatus is coupled to the loudspeaker arrangement for the purpose of outputting audio signals; and automatically adjusting the loudspeaker arrangement between the projecting position and the operating position depending on the operating state of the audio apparatus.

2. The method of claim 1, wherein the loudspeaker arrangement can be adjusted with respect to a loudspeaker arrangement receptacle, wherein the loudspeaker arrangement is at least partially recessed in the loudspeaker arrangement receptacle in the inoperative position, wherein the loudspeaker arrangement protrudes further out of the loudspeaker arrangement receptacle in the projecting position than in the inoperative position.

3. The method of claim 2, wherein automatically adjusting the loudspeaker arrangement between the inoperative position and the projecting position comprises automatically rotating and/or automatically shifting the loudspeaker arrangement with respect to the loudspeaker arrangement receptacle.

4. The method of claim 2, wherein automatically adjusting the loudspeaker arrangement between the projecting position and the operating position comprises automatically tilting and/or automatically rotating the loudspeaker arrangement with respect to the loudspeaker arrangement receptacle.

5. The method of claim 1, further comprising:

detecting a size of a person in the vehicle; and automatically tilting the loudspeaker arrangement depending on the size of the person.

6. The method of claim 1, wherein the loudspeaker arrangement comprises adjustable fins through which the audio signals from the loudspeaker arrangement are emitted, the method further comprising:

automatically adjusting the fins depending on the operating state of the audio apparatus.

7. The method of claim 6, further comprising:

detecting a size of a person in the vehicle; and automatically adjusting the fins depending on the size of the person.

8. The method of claim 1, wherein detecting the operating state of the vehicle comprises:

detecting a locking state of a door of the vehicle, and/or detecting a door-opening state which indicates whether a door of the vehicle is open, and/or detecting an ignition state which indicates that starting is enabled for a drive motor of the vehicle by a keyless start system of the vehicle, or indicates whether an ignition key is inserted into an ignition lock of the vehicle.

9. The method of claim 1, wherein detecting the operating state of the audio apparatus comprises:

detecting a user setting on the audio apparatus, with which user setting one or more seat positions in the vehicle is/are selected, and/or detecting a switch-on state of the audio apparatus, which indicates whether the audio apparatus is switched on.

10. The method of claim 1, further comprising:

illuminating at least a portion of the loudspeaker arrangement depending on the operating state of the vehicle.

11. A loudspeaker arrangement for a vehicle, comprising:

a drive which is designed to adjust the loudspeaker arrangement at least to an inoperative position, a projecting position and an operating position with respect to a loudspeaker arrangement receptacle; and a processing apparatus which is designed to drive the drive depending on an operating state of the vehicle and an operating state of an audio apparatus which is coupled to the loudspeaker arrangement for the purpose of outputting audio signals, wherein the processing apparatus is further designed to adjust the loudspeaker arrangement between the inoperative position and the projecting position depending on the operating state of the vehicle, and to adjust the loudspeaker arrangement between the projecting position and the operating position depending on the operating state of the audio apparatus.

12. A vehicle, comprising:

an audio apparatus; and a loudspeaker arrangement according to claim 11.

13. The vehicle of claim 12, wherein the loudspeaker arrangement comprises:

a front central loudspeaker arranged centrally in a dashboard of the vehicle in relation to the lateral direction of the vehicle, and/or a front side loudspeaker arranged to the outer left or to the outer right in a dashboard of the vehicle in relation to the lateral direction of the vehicle, and/or a rear central loudspeaker arranged centrally in a parcel shelf or loading-space cover of the vehicle in relation to the lateral direction of the vehicle, and/or a rear side loudspeaker is arranged to the outer left or to the outer right in a parcel shelf or loading-space cover of the vehicle in relation to the lateral direction of the vehicle.

* * * * *